US009383669B2

(12) United States Patent
Takahashi et al.

(10) Patent No.: US 9,383,669 B2
(45) Date of Patent: Jul. 5, 2016

(54) BRILLIANT TONER, DEVELOPER, TONER CARTRIDGE, PROCESS CARTRIDGE, AND IMAGE FORMING APPARATUS

(71) Applicant: FUJI XEROX CO., LTD., Tokyo (JP)

(72) Inventors: Masaru Takahashi, Kanagawa (JP); Sakiko Hirai, Kanagawa (JP); Shotaro Takahashi, Kanagawa (JP); Atsushi Sugitate, Kanagawa (JP); Shuji Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/781,030

(22) Filed: Feb. 28, 2013

(65) Prior Publication Data

US 2014/0045113 A1 Feb. 13, 2014

(30) Foreign Application Priority Data

Aug. 10, 2012 (JP) ..... 2012-179016

(51) Int. Cl.

| | |
|---|---|
| ***G03G 9/09*** | (2006.01) |
| ***G03G 9/087*** | (2006.01) |
| ***G03G 9/08*** | (2006.01) |

(52) U.S. Cl.

CPC ..... *G03G 9/08755* (2013.01); *G03G 9/0812* (2013.01); *G03G 9/0821* (2013.01); *G03G 9/0823* (2013.01); *G03G 9/0902* (2013.01); *G03G 9/0926* (2013.01)

(58) Field of Classification Search

CPC . G03G 9/0823; G03G 9/0821; G03G 9/0926; G03G 9/0902; G03G 9/08755

USPC ..... 430/111.41, 110.1, 110.3, 111.4, 108.1, 430/108.6, 108.7

See application file for complete search history.

(56) References Cited

U.S. PATENT DOCUMENTS

| | | | | |
|---|---|---|---|---|
| 7,951,519 | B2 * | 5/2011 | Iwazaki | G03G 9/0804 430/108.1 |
| 7,955,772 | B2 * | 6/2011 | Schuster et al. | 430/108.1 |
| 2006/0045571 | A1 * | 3/2006 | Matsuura et al. | 399/149 |
| 2011/0223385 | A1 * | 9/2011 | Shiao et al. | 428/144 |
| 2011/0318063 | A1 | 12/2011 | Takahashi et al. | |
| 2011/0318682 | A1 | 12/2011 | Takahashi et al. | |
| 2011/0318683 | A1 * | 12/2011 | Kadokura et al. | 430/105 |
| 2013/0260308 | A1 * | 10/2013 | Davis et al. | 430/110.2 |

FOREIGN PATENT DOCUMENTS

| | | | |
|---|---|---|---|
| JP | A-4-204853 | | 7/1992 |
| JP | 2001-255701 | A | 9/2001 |
| JP | 2006-330689 | A | 12/2006 |
| JP | 2007-519982 | A | 7/2007 |
| JP | A-2012-32765 | | 2/2012 |
| WO | 2005/076086 | A1 | 8/2005 |

OTHER PUBLICATIONS

Jan. 5, 2016 Office Action issued in Japanese Application No. 2012-179016.

* cited by examiner

*Primary Examiner* — Janis L Dote
(74) *Attorney, Agent, or Firm* — Oliff PLC

(57) ABSTRACT

Provided is a brilliant toner containing a brilliant metallic pigment of which the surface is covered with at least one kind of metal oxides selected from a group consisting of silica, alumina, and titania, wherein the brilliant toner has a dielectric loss factor of from $10\times10^{-3}$ to $60\times10^{-3}$.

20 Claims, 3 Drawing Sheets

BRILLIANT TONER, DEVELOPER, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-179016 filed Aug. 10, 2012.

BACKGROUND

1. Technical Field

The present invention relates to a brilliant toner, a developer, a toner cartridge, a process cartridge, and an image forming apparatus.

2. Related Art

For the purpose of forming an image having brilliance similar to metallic luster, a brilliant toner is used.

SUMMARY

According to an aspect of the invention, there is provided a brilliant toner containing a brilliant metallic pigment of which the surface is covered with at least one kind of metal oxides selected from a group consisting of silica, alumina and titania, wherein the dielectric loss factor thereof is from $10\times10^{-3}$ to $60\times10^{-3}$.

BRIEF DESCRIPTION OF THE DRAWINGS

Exemplary embodiments of the present invention will be described in detail based on the following figures, wherein.

DETAILED DESCRIPTION

Figure 1:
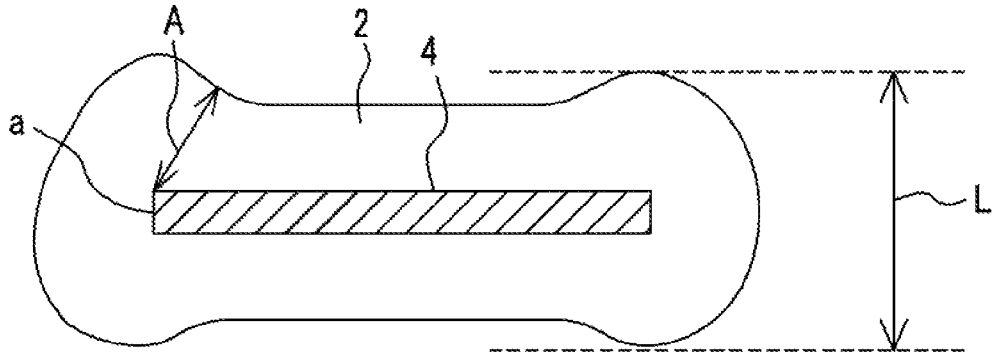
FIG. 1 is a cross-sectional view of toner in a thickness direction according to an exemplary embodiment.

Hereinafter, an exemplary embodiment of a brilliant toner, a developer, a toner cartridge, a process cartridge, and an image forming apparatus according to the invention will be described in detail.

Brilliant Toner

A brilliant toner according to an exemplary embodiment of the invention (hereinafter, sometimes referred to as the toner according to the exemplary embodiment) contains a brilliant metallic pigment of which the surface is covered with at least one kind of metal oxides selected from a group consisting of silica, alumina, and titania, and the brilliant toner has a dielectric loss factor of from $10\times10^{-3}$ to $60\times10^{-3}$.

The dielectric loss factor of a color toner or a black toner used in the related art is in a range from about $10\times10^{-3}$ to $60\times10^{-3}$, and the dielectric loss factor of the toner according to the exemplary embodiment is the same as the dielectric loss factor of the color toner or the black toner used in the related art, regardless of the fact that the toner according to the exemplary embodiment contains a brilliant metallic pigment.

The term "brilliant" in the exemplary embodiment indicates that an image has brilliance similar to metallic luster when the image formed by the toner according to the exemplary embodiment is visually checked.

As a case where a color brilliant image is output, when color toner is superimposed on silver toner using a brilliant metallic pigment, in some cases, it is necessary to transfer an image under a high voltage in order to collectively transfer multiple toner layers. Since a toner containing a brilliant metallic pigment of the related art has a high dielectric loss factor, the charge amount of the toner is lowered by charge injection under a high voltage of AC bias. As a result, there are problems in the deterioration of transfer efficiency and brilliant properties.

The dielectric loss factor of the toner according to the exemplary embodiment is in a range from $10\times10^{-3}$ to $60\times10^{-3}$ regardless of the fact that the toner according to the exemplary embodiment contains a brilliant metallic pigment. The reason is not clear, but is assumed to be as below.

Since metals have a conductive property, when a brilliant metallic pigment is exposed on the surface of the brilliant toner in which the brilliant metallic pigment is used for a colorant, a charging property of the toner is affected. Therefore, in some cases, the dielectric loss factor of the toner becomes higher than the dielectric loss factor of a color toner or a black toner used in the related art. In the exemplary embodiment, a brilliant metallic pigment of which the surface is covered with a specific metal oxide is used as a colorant. Since in a brilliant metallic pigment of which the surface is covered with a specific metal oxide, the specific metal oxide uniformly covers metallic particles having a conductive property, and the surface of the metal oxide has minute asperities and binder resin is easily attached to the surface thereof, the brilliant metallic pigment is suppressed from being exposed on a surface of the toner. Particularly, coatability of edge portions of the flake-shaped brilliant metallic pigment is improved. As a result, it is assumed that the dielectric loss factor of the toner according to the exemplary embodiment is in a range from $10\times10^{-3}$ to $60\times10^{-3}$. When the dielectric loss factor thereof is in a range from $10\times10^{-3}$ to $60\times10^{-3}$, it is assumed that the charge injection to the toner under a high voltage of AC bias is suppressed and the deterioration of transfer efficiency and brilliant properties is suppressed.

In the exemplary embodiment, the dielectric loss factor of the toner is measured in such a manner that the toner is press-molded at 98067 KPa (1000 kgf/cm$^2$) for two minutes to be a disc-shaped form having a diameter of 50 ram and a thickness of 3 mm, and then the toner is allowed to stand at 30° C. for 24 hours under an atmosphere of 90% relative humidity, thereby obtaining a value for the dielectric loss which is measured under this environment.

The measurement is performed by setting the toner between electrodes for solids materials having an electrode diameter of 38 mm (manufactured by Ando Denki Co., Ltd., SE-71 type) and measuring the toner under the conditions of 1000 Hz and 5.0 V, using a dielectric measurement system (manufactured by Solartron Co., Ltd., 126096W type).

In the toner according to the exemplary embodiment, when a cross section of the toner in a thickness direction thereof is observed, the average value of the shortest distance from the top of the brilliant metallic pigment in a long axis direction thereof to the surface of the toner is preferably in a range from 0.1 μm to 1.0 μm. When the distance from the brilliant metallic pigment to the surface of the toner is maintained at the average value in a range from 0.1 μm to 1.0 μm, the charge injection does not easily occur and the dielectric loss factor easily becomes from $10\times10^{-3}$ to $60\times10^{-3}$. As a result, it is assumed that when the toner according to the exemplary embodiment is used, an image having excellent brilliant properties is formed.

The average value of the shortest distance from the top of the brilliant metallic pigment in a long axis direction thereof to the surface of the toner is more preferably from 0.2 μm to 0.7 μm, and particularly preferably from 0.3 μm to 0.6 μm.

The distance from the top of the brilliant metallic pigment of the exemplary embodiment in a long axis direction thereof to the surface of the toner will be described based on the drawings. FIG. 1 is a cross-sectional view of toner in a thickness direction according to an exemplary embodiment. Toner 2 shown in FIG. 1 is flake-shaped toner in which the equivalent circle diameter is longer than a thickness L, and contains flake-like pigment particles 4 (corresponding to a brilliant metallic pigment).

In FIG. 1, a distance A from the top a of the pigment particle 4 in a long axis direction thereof to the surface of the toner 2 corresponds to the distance from the top of the brilliant metallic pigment of the exemplary embodiment in the long axis direction thereof to the surface of the toner. The minimum value of the distance A (that is, the shortest distance from the top of the brilliant metallic pigment in the long axis direction thereof to the surface of the toner) is measured for each toner particle. The average value of the minimum values of the distances A for 100 toner particles is preferably in a range from 0.1 μm to 1.0 μm.

FIG. 1 shows a state where single pigment particle 4 in the toner 2 is observed, but plural pigment particles 4 may be present in the toner 2. The minimum value of the distance A when plural pigment particles 4 in the toner 2 are observed means the minimum value among the values in the distance A from the top a of each pigment particle 4 in the long axis direction thereof to the surface of the toner 2.

Specifically, the distance from the top of the brilliant metallic pigment in the long axis direction thereof to the surface of the toner is measured by a following method.

The toner particles are embedded using a bisphenol A type liquid epoxy resin and a curing agent, and then a sample for cutting is prepared. Thereafter, the sample for cutting is cut at −100° C. by using a cutting machine with a diamond knife (a LEICA Ultramicrotome (manufactured by Hitachi Technologies and Services, Ltd.) is used in the exemplary embodiment), thereby preparing a sample for observation. With respect to the observation sample, the cross section of the toner in the thickness direction thereof is observed with a transmission electron microscope (TEM) at around 5000 times magnification. With respect to the observed 1000 toner particles, the shortest distance from the top of the brilliant metallic pigment in the long axis direction to the surface of the toner is measured by using image analysis software, thereby calculating the average thereof.

In the toner of the exemplary embodiment, when a solid image is formed, a ratio (A/B) of a reflectance A at a light receiving angle of +30° to a reflectance B at a light receiving angle of −3.0°, which are reflectances measured when the image is irradiated with incident light at an incident angle of −45° using a goniophotometer, is preferably from 2 to 100.

If the ratio (A/B) is equal to or greater than 2, this indicates that light is reflected more toward a side ("angle+" side) opposite to the light incident side than toward a side ("angle−" side) where the incident light enters, that is, this indicates that diffuse reflection of the incident light is inhibited. When the diffuse reflection in which the incident light is reflected to various directions is caused, if the reflected light is visually checked, colors look blurry. Therefore, when the ratio (A/B) is less than 2, if the reflected light is visually checked, brilliance is not confirmed, thereby causing inferior brilliant properties in some cases.

On the other hand, when the ratio (A/B) exceeds 100, a viewing angle in which the reflected light may be visually checked is narrowed too much, and specular reflected light components are large. Therefore, a phenomenon in which colors look darkish depending on angles may occur. In addition, it is also difficult to prepare a toner in which the ratio (A/B) exceeds 100.

The ratio (A/B) is preferably from 50 to 100, more preferably from 60 to 90, and particularly preferably from 70 to 80.

Measurement of Ratio (A/B) Using Goniophotometer

First, an incident angle and a light receiving angle will be described. In the exemplary embodiment, when the measurement is performed using a goniophotometer, the incident angle is set to −45°. This is because the sensitivity of the measurement is high with respect to images of a wide range of brilliance.

In addition, the reason why the light receiving angle is set to −30' and +30' is that the sensitivity of the measurement is the highest for evaluating images having and not having the impression of brilliance.

Next, the method of measuring the ratio (A/B) will be described.

In the exemplary embodiment, when the ratio (A/B) is measured, first, a "solid image" is formed in the following manner. A developer as a sample is filled in a developing unit of a DOCUCENTRE-III C7600 manufactured by Fuji Xerox Co., Ltd., and a solid image in which an amount of toner applied is 4.5 g/cm$^2$ is formed on a sheet of recording paper (OK TOPCOAT+ paper manufactured by Oji Paper Co., Ltd.) at a fixing temperature of 190° C. and at a fixing pressure of 4.0 kg/cm$^2$. The "solid image" refers to an image of 100% printing rate.

By using a goniospectrocolorimeter GC5000L manufactured by NIPPON DENSHOKU INDUSTRIES CO., LTD. as a goniophotometer, incident light that enters the solid image at an incident angle of −45' enters the image portion of the formed solid image, and the reflectance A at a light receiving angle of +30° and the reflectance B at a light receiving angle of −30' are measured. The reflectances A and B are measured with respect to light having a wavelength ranging from 400 nm to 700 nm at an interval of 20 nm, and the average value of the reflectance at each wavelength is calculated. The ratio (A/B) is calculated from the measurement results.

Configuration of Toner

From the viewpoint of satisfying the ratio (A/B) described above, the toner according to the exemplary embodiment may preferably meet the requirements (1) and (2) below.

(1) The toner has an average equivalent circle diameter D larger than an average maximum thickness C.

(2) When a cross section of the toner in a thickness direction thereof is observed, the number of pigment particles arranged so that an angle formed by a long axis direction of the toner in the cross Section and a long axis direction of a pigment particle is in a range of −30° to +30° is equal to or greater than 60% of the total number of pigment particles observed.

As a toner satisfying the requirements (1) and (2) described above, the toner 2 as shown in FIG. 1 is exemplified.

As shown in FIG. 1, in a case where the toner 2 has a flake shape having an equivalent circle diameter larger than a thickness L, when the toner is moved to an image holing member, an intermediate transfer medium, a recording medium, or the like in a step of development or a step of transferring in image formation, the toner tends to move so as to cancel out the charge of the toner to the maximum extent. Therefore, it is considered that the toner is arranged such that the adhering area becomes the maximum. That is to say, it is considered that the flake-shaped toner is arranged such that the flake surface side of the toner faces a surface of a recording medium onto which the toner is finally transferred. Moreover, in a step of fixing in image formation, it is considered that the flake-shaped toner is also arranged by the pressure during fixing such that the flake surface side of the toner faces the surface of the recording medium.

Accordingly, among the flake-like pigment particles contained in the toner, pigment particles that satisfy the requirement "an angle formed by a long axis direction of the toner in the cross section and a long axis direction of a pigment particle is in a range of −30° to +30°" described in (2) above are considered to be arranged such that the surface side, which provides the maximum area, faces the surface of the recording medium. When an image formed in this manner is irradiated with light, it is considered that the proportion of pigment particles, which cause diffuse reflection of incident light, is reduced and thus the above-described range of the ratio (A/B) may be achieved. Further, if the proportion of pigment particles, which cause diffuse reflection of incident light, is reduced, the reflected light intensity varies greatly depending on angles, thereby obtaining more ideal brilliant properties.

Next, the composition of the toner according to the exemplary embodiment will be described.

The toner according to the exemplary embodiment includes at least the brilliant metallic pigment, and preferably further includes a binder resin and a release agent.

Brilliant Metallic Pigment

In the exemplary embodiment, a brilliant metallic pigment is used as a colorant. A brilliant metallic pigment used in the exemplary embodiment is a pigment of which the surface is covered with at least one kind of metal oxide selected from a group consisting of silica, alumina and titania.

As a pigment before being covered with metal oxide, powders of metals such as aluminum, brass, bronze, nickel, stainless steel, and zinc, and copper, silver, gold, platinum or the like are exemplified.

Examples of the coating method in which the surface is covered with metal oxide include a method in which a coating layer of metal oxide is formed on the surface of the brilliant metallic pigment by a sol-gel method and a method in which a coating layer of metal oxide is formed by precipitating metal hydroxide on the surface of the brilliant metallic pigment and then performing crystallization at a low temperature.

The brilliant metallic pigment in the toner according to the exemplary embodiment preferably has a volume average particle diameter of less than or equal to 20 μm.

The content of the brilliant metallic pigment in the toner according to the exemplary embodiment is preferably from 1 part by weight to 70 parts by weight and more preferably from 5 parts by weight to 50 parts by weight, with respect to 100 parts by weight of binder resin described below.

Binder Resin

Examples of the binder resin which is used in the exemplary embodiment include ethylene-based resins such as polyester, polyethylene and polypropylene; styrene-based resins such as polystyrene and α-polymethylstyrene; (meth) acrylic resins such as polymethyl methacrylate and polyacrylonitrile; polyamide resins; polycarbonate resins; polyether resins; and copolymer resins thereof. Among these resins, polyester resins are preferably used from the viewpoint of high smoothness on a surface of a fixed image and superior brilliance.

Hereinafter, polyester resins that are particularly preferably used will be described.

The polyester resins according to the exemplary embodiment may be those obtained by, for example, polycondensation of a polyvalent carboxylic acid and a polyol.

Examples of the polyvalent carboxylic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid. One or more of these polyvalent carboxylic acids are used.

Among these polyvalent carboxylic acids, the aromatic carboxylic acids are preferably used. Furthermore, in order to improve a fixing property and to form a cross-linked structure or a branched structure, a trivalent or higher carboxylic acid (such as trimellitic acid or an anhydride thereof) is preferably used in combination with a dicarboxylic acid.

Examples of the polyol include aliphatic diols such as ethylene glycol, diethylene glycol, triethylene propylene glycol, butanediol hexanediol, neopentyl and glycerin; alicyclic diols such as cyclohexanediol cyclohexanedimethanol, and hydrogenated bisphenol A; and aromatic diols such as ethylene oxide adducts of bisphenol A and propylene oxide adducts of bisphenol A. one or more of these polyols are used.

Among these polyols, aromatic diols and alicyclic diols are preferable. Among these, aromatic diols are more preferable. Furthermore, in order to further improve a fixing property and to form a cross-linked structure or a branched structure, a trivalent or higher polyol (such as glycerin, trimethylolpropane, or pentaerythritol) may also be used in combination with a diol.

Method of Preparing Polyester Resin

A method of preparing a polyester resin is not particularly limited, and the polyester resin is prepared by a normal polyester polymerization method in which an acid component is reacted with an alcohol component. For example, the polyester resin is prepared by properly employing a direct polycondensation method, an ester interchange method, or the like depending on the types of monomers used. The molar ratio (acid component/alcohol component) in the reaction between the acid component and the alcohol component varies depending on the reaction conditions and the like. However, in order to obtain a high molecular weight, the molar ratio is preferably about 1/1 in general.

Examples of catalysts usable for preparing the polyester resin include alkali metal compounds such as sodium or lithium; compounds of an alkaline earth metal such as magnesium or calcium; compounds of a metal such as zinc, manganese, antimony, titanium, tin, zirconium, or germanium; phosphorous acid compounds; phosphoric acid compounds; and amine compounds.

Release Agent

Examples of the release agent which is used in the exemplary embodiment include paraffin wax such as low-molecular weight polypropylene and low-molecular weight polyethylene; silicone resins; rosins; rice wax; and carnauba wax. The melting temperature of the release agent is preferably from 50° C. to 100° C., and more preferably from 50° C. to 95° C.

The content of the release agent in the toner is preferably from 0.5% by weight to 15% by weight, and more preferably from 1.0% by weight to 12% by weight.

Other Additives

Besides the components described above, other components such as an internal additive, a charge-controlling agent, an inorganic powder (inorganic particles), and organic particles may also be used in the exemplary embodiment, as necessary.

Examples of the charge-controlling agent include quaternary ammonium salt compounds, nigrosine compounds, dyes containing a complex of aluminum, iron, chromium, or the like, and triphenylmethane-based pigments.

Examples of the inorganic particles include known inorganic particles such as silica particles, titanium oxide particles, alumina particles, cerium oxide particles, and particles obtained by hydrophobizing the surfaces of these particles. These inorganic particles may be used alone or in combinations of two or more kinds thereof. Among these inorganic particles, silica particles, which have a refractive index lower than that of the above-described binder resin, are preferably used. The silica particles may be subjected to various surface treatments. For example, silica particles surface-treated with a silane coupling agent, a titanium coupling agent, silicone oil, or the like are preferably used.

Characteristics of Toner

Average Maximum Thickness C and Average Equivalent-Circle Diameter D

As described in (1) above, the toner according to the exemplary embodiment preferably has the average equivalent-circle diameter D larger than the average maximum thickness C thereof. Moreover, the ratio (C/D) of the average maximum thickness C to the average equivalent-circle diameter is more preferably in a range of from 0.001 to 0.500, further preferably in a range of from 0.010 to 0.200, and particularly preferably in a range of from 0.050 to 0.100.

When the ratio (C/D) is 0.001 or more, the strength of the toner may be ensured, and breakage of the toner due to a stress during image formation may be suppressed. Thus, a decrease in charges, the decrease being caused by exposure of the pigment, and fogging caused as a result thereof may be suppressed. On the other hand, when the ratio (C/D) is 0.500 or less, a good brilliance may be obtained.

The average maximum thickness C and the average equivalent-circle diameter D are measured by the methods below.

Toner particles are placed on a smooth surface and uniformly dispersed by applying vibrations. One thousand toner particles are observed with a color laser microscope "VK-9700" (manufactured by Keyence Corporation) at a magnification of 1000 times to measure the maximum thickness C and the equivalent-circle diameter U of a surface viewed from the top, and the arithmetic averages thereof are calculated to determine the average maximum thickness C and the average equivalent-circle diameter D.

Angle Formed by Long Axis Direction of Toner in Cross Section and Long Axis Direction of Pigment Particles As described in (2) above, when a cross section of a toner in the thickness direction thereof is observed, the number of pigment particles arranged so that an angle formed by a long axis direction of the toner in the cross section and a long axis direction of a pigment particle is in the range of −30° to +30° is preferably 60% or more of the total number of pigment particles observed. Furthermore, the number is more preferably from 70% to 95%, and particularly preferably from 80% to 90%.

When the above number is 60% or more, a good brilliance may be obtained.

Herein, a method of observing a cross section of a toner will be described.

The toner particles are embedded using a bisphenol A-type liquid epoxy resin and a curing agent, and then a sample for cutting is prepared. Thereafter, the sample for cutting is cut at −100° C. using a cutting machine with a diamond knife (a LEICA Ultramicrotome (manufactured by Hitachi Technologies Corporation) is used in the exemplary embodiment), thereby preparing a sample for observation. With respect to the observation sample, the cross sections of the toner particles are observed with a transmission electron microscope (TEM) at around 5000 times magnification. With respect to the observed 1000 toner particles, the number of pigment particles arranged so that the angle formed by the long axis direction of a toner in the cross section and the long axis direction of a pigment particle is in the range of −30' to +30° is counted using image analysis software, and the proportion thereof is calculated.

The term "long axis direction of toner in the cross section" refers to a direction orthogonal to a thickness direction of toner having an average equivalent-circle diameter P larger than the average maximum thickness C, and the term "long axis direction of a pigment particle" refers to a length direction of the pigment particle.

The volume average particle diameter of the toner according to the exemplary embodiment is preferably from 1 μm to 30 μm, more preferably from 3 μm to 20 μm, and further preferably from 5 μm to 10 μm.

The volume average particle diameter $D_{50v}$ is determined as follows. A cumulative volume distribution curve and a cumulative number distribution curve are drawn from the smaller particle diameter end, respectively, for each particle diameter range (channel) divided on the basis of a particle diameter distribution measured with a measuring instrument such as a Multisizer II (manufactured by Beckman Coulter Inc.). The particle diameter providing 16% accumulation is defined as that corresponding to volume $D_{16v}$ and number $D_{16p}$, the particle diameter providing 50% accumulation is defined as that corresponding to volume $D_{50v}$ and number $D_{50p}$, and the particle diameter providing 84% accumulation is defined as that corresponding to volume $D_{84v}$ and number $D_{84p}$. The volume average particle diameter distribution index (GSDv) is calculated as $(D_{84v}/D_{16v})^{1/2}$ using these values.

Method of Preparing Toner

The toner according to the exemplary embodiment may be prepared by preparing toner particles and then adding an external additive to the toner particles.

A method of preparing toner particles is not particularly limited, and examples thereof include well-known methods including a dry method such as a kneading and pulverizing method and wet methods such as an emulsification aggregation method, a suspension polymerization method and a dissolution suspension method.

In the kneading and pulverizing method, the respective materials including a colorant are mixed, the resultant is melted and kneaded with a kneader, an extruder or the like, and the obtained melted and kneaded material is coarsely pulverized and then finely pulverized with a jet mill or the like, followed by classification with an air classifier. As a result, toner particles having a desired particle diameter are obtained.

Among the methods, an emulsification aggregation method is preferable from the viewpoints that the shape and particle diameter of toner particles are easily controlled and a control range of a structure of toner particles, such as a core-shell structure, is wide. Moreover, the emulsification aggregation method is preferable from the viewpoints that the shape and particle diameter of toner particles are easily controlled and a pigment may uniformly be covered with toner resins.

Hereinafter, a method of preparing toner particles with the emulsification aggregation method will be described in detail.

The emulsification aggregation method according to the exemplary embodiment includes an emulsification process of emulsifying base materials of toner particles and forming resin particles (emulsified particles), an aggregation process of forming aggregates of the resin particles, and a coalescence process of coalescing the aggregates.

Emulsification Process

A resin particle dispersion may be prepared by a disperser applying a shearing force to a solution, in which an aqueous medium and binder resin are mixed, to be emulsified, as well as by using well-known polymerization methods such as an emulsification polymerization method, a suspension polymerization method, and a dispersion polymerization method. At this time, particles may be formed by heating a resin component to lower the viscosity thereof. In addition, in order to stabilize the dispersed resin particles, a dispersant may be used. Furthermore, when resin is dissolved in an oil-based solvent having relatively low solubility in water, the resin is dissolved in the solvent and particles thereof are dispersed in water with a dispersant and a polymer electrolyte, followed by heating and reduction in pressure to evaporate the solvent. As a result, the resin particle dispersion is prepared.

Examples of the aqueous medium include water such as distilled water or ion exchange water; and alcohols, and water is preferable.

In addition, examples of the dispersant which is used in the emulsification process include a water-soluble polymer such as polyvinyl alcohol, methyl cellulose, ethyl cellulose, hydroxyethyl cellulose, carboxymethyl cellulose, sodium polyacrylate, or sodium polymethacrylate; a surfactant such as an anionic surfactant (for example, sodium dodecylbenzenesulfonate, sodium octadecylsulfate, sodium oleate, sodium laurate, or potassium stearate), a cationic surfactant (for example, laurylamine acetate, stearylamine acetate, or lauryltrimethylammonium chloride), a zwitterionic surfactant (for example, lauryl dimethylamine oxide), or a nonionic surfactant (for example, polyoxyethylene alkyl ether, polyoxyethylene alkyl phenyl ether, or polyoxyethylene alkylamine); and an inorganic salt such as tricalcium phosphate, aluminum hydroxide, calcium sulfate, calcium carbonate, or barium carbonate.

Examples of the disperser which is used for preparing an emulsion include a homogenizer, a homomixer, a pressure kneader, an extruder, and a media disperser. With regard to the size of the resin particles, the average particle diameter (volume average particle diameter) thereof is preferably less than or equal to 1.0 μm, more preferably from 60 nm to 300 nm, and still more preferably from 150 nm to 250 nm. When the volume average particle diameter thereof is greater than or equal to 60 nm, the resin particles are likely to be unstable in the dispersion and thus the aggregation of the resin particles may be easy. In addition, when the volume average particle diameter thereof is less than or equal to 1.0 μm, the particle diameter distribution of the toner particles may be narrowed.

When a release agent particle dispersion is prepared, a release agent is dispersed in water with an ionic surfactant and a polyelectrolyte such as a polyacid or a polymeric base and the resultant is heated at a temperature higher than or equal to the melting point of the release agent, followed by dispersion using a homogenizer to which strong shearing force is applied or a pressure extrusion type disperser. Through the above-described process, a release agent particle dispersion is obtained. During the dispersion, an inorganic compound such as polyaluminum chloride may be added to the dispersion. Preferable examples of the inorganic compound include polyaluminum chloride, aluminum sulfate, high basic polyaluminum chloride (BAC), polyaluminum hydroxide, and aluminum chloride. Among these, polyaluminum chloride and aluminum sulfate are preferable. The release agent particle dispersion is used in the emulsification aggregation method, but may also be used when the toner is prepared in the suspension polymerization method.

Through the dispersion, the release agent particle dispersion having release agent particles with a volume average particle diameter of 1 μm or less is obtained. It is more preferable that the volume average particle diameter of the release agent particles be from 100 nm to 500 nm.

When the volume average particle diameter is greater than or equal to 100 nm, although also being affected by properties of the binder resin to be used, in general, it is easy to mix a release agent component into toner. In addition, when the volume average particle diameter is less than or equal to 500 nm, the dispersal state of the release agent in the toner may be satisfactory.

When a colorant (brilliant metallic pigment) dispersion is prepared, a well-known dispersion method may be used. For example, general dispersion units such as a rotary-shearing homogenizer, a ball mill having a medium, a sand mill, a dyno mill, or an ultimizer are used, and the dispersion method is not limited thereto. The colorant is dispersed in water with an ionic surfactant and a polyelectrolyte such as a polyacid or a polymeric base. The volume average particle diameter of the dispersed colorant particles may be less than or equal to 20 μm. However, the volume average particle diameter of the dipersed colorant particles is preferably in a range of from 3 μm to 16 μm because the colorant is satisfactory dispersed in the toner without impairing aggregability.

The brilliant metallic pigment and binder resin may be dispersed and dissolved in a solvent and mixed, and the resultant may be dispersed in water through phase inversion emulsification or shearing emulsification, thereby preparing a dispersion of the brilliant metallic pigment coated with the binder resin.

Aggregation Process

In the aggregation process, the resin particle dispersion, the colorant dispersion, the release agent dispersion and the like are mixed to obtain a mixture and the mixture is heated at the glass transition temperature or less of the resin particles and aggregated to form aggregated particles. In most cases, the aggregated particles are formed by adjusting the pH value of the mixture to be acidic under stirring. Under the above-described stirring conditions, the ratio (C/D) may be adjusted to be in a preferable range. Specifically, by performing the stirring faster and applying heat in the stage of forming aggregated particles, the ratio (C/D) may decrease. In addition, by performing the stirring slower and applying heat at a low temperature, the ratio (C/U) may increase. The pH value is preferably from 2 to 7. At this time, use of a coagulant is also effective.

In the aggregation process, the release agent dispersion and other various dispersions such as the resin particle dispersion may be added and mixed at once or may be added many times in separate portions.

In the aggregation process, for example, a stirring blade that has two paddles and forms a laminar flow is used, and the stirring is performed at a high stirring speed (from 500 rpm to 1500 rpm, for example). In this manner, the brilliant metallic pigment particles are oriented in the long axis direction in the aggregated particles, and the aggregated particles also aggregate in the long axis direction, whereby the thickness of the toner is reduced (that is, the above-described requirement (1) is satisfied).

As the coagulant, a surfactant having a reverse polarity to that of a surfactant which is used as the dispersant, an inorganic metal salt, and a divalent or higher valent metal complex may be preferably used. In particular, the metal complex is particularly preferable because the amount of the surfactant used may be reduced and charging characteristics are improved.

Preferable examples of the inorganic metal salt include an aluminum salt and a polymer thereof. In order to obtain a narrower particle diameter distribution, a divalent inorganic metal salt is preferable to a monovalent inorganic metal salt, a trivalent inorganic metal salt is preferable to a divalent inorganic metal salt, and a tetravalent inorganic Metal salt is preferable to a trivalent inorganic metal salt. Even in a case of inorganic metal salts having the same valence, a polymeric type of inorganic metal salt polymer is more preferable.

In the exemplary embodiment, in order to obtain a narrower particle diameter distribution, a tetravalent inorganic metal salt polymer containing aluminum is preferably used.

After the aggregated particles have desired particle diameters, the resin particle dispersion is additionally added (coating process). According to this, a toner having a configuration in which the surfaces of core aggregated particles are coated with resin may be prepared. In this case, the release agent and the colorant are not easily exposed to the surface of the toner, which is preferable from the viewpoints of charging characteristics and developability. In a case of additional addition, a coagulant may be added or the pH value may be adjusted before additional addition.

Coalescence Process

In the coalescence process, under stirring conditions based on those of the aggregation process, by increasing the pH value of a suspension of the aggregated particles to be in a range of from 3 to 9, the aggregation is stopped. By performing heating at the glass transition temperature or higher of the resin, the aggregated particles are coalesced. In addition, when the resin is used for coating, the resin is also coalesced and coats the core aggregated particles. The heating time may be determined according to a coalescing degree and may be approximately from 0.5 hour to 10 hours.

In the coalescence process, by coalescing the aggregated particles at a lower temperature (for example, from 60° C. to 80° C.) the movement caused by the rearrangement of the materials is reduced and the orientation of the pigment is maintained. Therefore, toner particles in which the above-described requirement (2) is satisfied are obtained.

After coalescing, cooling is carried out to obtain coalesced particles. In addition, in a cooling process, a cooling rate may be reduced around the glass transition temperature of the resin (the range of the glass transition temperature ±10° C.), that is, slow cooling may be carried out to promote crystallization.

The coalesced particles, which are obtained by coalescing, may be subjected to a sold-liquid separation process such as filtration, or, as necessary, a cleaning process and drying process to obtain toner particles.

In order to adjust charging, impart fluidity, and impart a charge exchange property, inorganic oxides or the like which are represented by silica, titania, and alumina may be added and attached to the obtained toner particles, as an external additive. The above-described processes may be performed with a V-SHAPE blender, a HENSCHEL mixer, a LOEDIGE mixer or the like and the attachment is performed in plural steps. The amount of the external additive added is preferably in a range of from 0.1 part to 5 parts and more preferably in a range of from 0.3 part to 2 parts, with respect to 100 parts of the toner particles.

After the external addition, coarse toner particles may be removed, as necessary, using an ultrasonic sieving machine, a vibrating sieving machine, an air classifier or the like.

In addition to the above-described inorganic oxides or the like, other components (particles), such as a charge-controlling agent, organic particles, a lubricant, and an abrasive may be added as an external additive.

The charge-controlling agent is not particularly limited, and a colorless or light-color material is preferably used. Examples thereof include quaternary ammonium salt compounds, nigrosine compounds, a complex of aluminum, iron, chromium, or the like, and triphenylmethane-based pigments Examples of the organic particles include particles of vinyl resins, polyester resins, silicone resins, and the like, which are generally used for surfaces of toner particles as the external additive. In addition, the organic particles and inorganic particles are used as a flow auxiliary agent, a cleaning aid, or the like.

Examples of the lubricant include fatty acid amides such as ethylene bis stearamide and oleamide; and fatty acid metal salts such as zinc stearate and calcium stearate.

Examples of the abrasive include silica, alumina, and cerium oxide described above.

Next, the preparation method of toner particles by a dissolution suspension method will be described in detail.

The dissolution suspension method is a method in which a material containing binder resin, a colorant and other components such as a release agent which is used as necessary, is dissolved or dispersed in a solvent that enables the binder resin to be dissolved, the obtained liquid is then granulated in an aqueous medium containing an inorganic dispersant and thereafter the solvent is removed so as to obtain toner particles.

Examples of the other components which are used in the dissolution suspension method include an internal additive, a charge-controlling agent, an inorganic powder (inorganic particles) and organic particles, in addition to a release agent.

In the exemplary embodiment, the binder resin, the colorant and the other components, which are used as necessary, are dissolved or dispersed in a solvent that enables the binder resin to be dissolved. It is determined whether or not the solvent enables the binder resin to be dissolved depending on structural components of the binder resin, a molecular chain length, a degree of three-dimensional chemical structure or the like. In general, examples of the solvent include hydrocarbons such as toluene, xylene, and hexane; halogenated hydrocarbons such as methylene chloride, chloroform, dichloroethane, and dichloroethylene; alcohols or ethers such as ethanol, butanol, benzyl alcohol ethyl ether, benzyl alcohol isopropyl ether, tetrahydrofuran, and tetrahydropyran; esters such as methyl acetate, ethyl acetate, butyl acetate, and isopropyl acetate; ketones or acetals such as acetone, methyl ethyl ketone, diisobutyl ketone, dimethyl oxide, diacetone alcohol, cyclohexanone, and methylcyclohexanone.

The above-described solvents dissolve binder resins and it is not necessary for the solvents to dissolve a colorant and other components. The colorant and the other components may be dispersed in the binder resin dispersion. The amount of the solvent used is not limited as long as the viscosity thereof enables the solvent to allow granulation in an aqueous medium. The ratio of the material containing binder resin, a colorant and other components (the former) to the solvent (the latter) is preferably 10/90 (weight ratio of the former to the latter) to 50/50, from the viewpoint of easy granulation and final yield of toner particles.

The liquid (mother liquid of toner) in which binder resin, a colorant and other components are dissolved or dispersed in solvent is granulated such that the particle diameter thereof is a predetermined particle diameter in an aqueous medium containing an inorganic dispersant. Water is mainly used for the aqueous medium. The mixing ratio (weight ratio) of the aqueous medium and the mother liquid of toner is preferably 90/10 (aqueous medium/mother liquid) to 50/50. The inorganic dispersant is preferably selected from tricalcium phosphate, hydroxyapatite, calcium carbonate, titanium oxide, and silica powder. The amount of the inorganic dispersant used is determined depending on the particle diameter of particles to be granulated. However, in general, the use amount thereof is preferably in a range of from 0.1% by weight to 15% by weight, with respect to the mother liquid of toner. When the used amount thereof is less than 0.1% by weight, it is difficult to perform a satisfactory granulation. When the use amount thereof exceeds 15% by weight, unnecessary fine particles are generated. According to this, it is difficult to obtain desired particles with high yield.

In order to granulate satisfactory mother liquid of toner in an aqueous medium containing an inorganic dispersant, an auxiliary agent may be added to the aqueous medium. Examples of the auxiliary agent include well-known cationic, anionic and nonionic surfactants, and the anionic surfactant is particularly preferable. Examples of anionic surfactant include sodium alkylbenzene sulfonate, sodium α-olefinsulfonate and sodium alkylsulfonate. The amount of these examples used is preferably in a range of from $1\times10^{-4}$% by weight to 0.1% by weight, with respect to the mother liquid at toner.

The granulation of the mother liquid of toner in an aqueous medium containing an inorganic dispersant is preferably carried out under shearing. The granulation of the mother liquid of toner which is dispersed in an aqueous medium is carried out such that the average particle diameter thereof is preferably less than or equal to 20 μm. Particularly, the average particle diameter thereof is preferably from 3 μm to 15 μm.

As a device including a shearing mechanism, various dispersers are exemplified. Among these, a homogenizer is preferable. By using a homogenizer, substances which are incompatible with each other (in the exemplary embodiment, the aqueous medium containing an inorganic dispersant and the mother liquid of toner) are subjected to passing through a gap between a casing and a rotating rotor. Therefore, a substance, which is incompatible with liquid, is particle-dispersed in the liquid. Examples of the homogenizer include a TK HOMOMIXER, a LINE FLOW HOMOMIXER, an AUTO-HOMOMIXER (all described above are manufactured by Tokushukika Kogyo K.K.), a SILVERSON homogenizer (manufactured by Silverson) and a POLYTRON homogenizer (manufactured by KINEMATICA AG).

A stirring Condition using a homogenizer is preferably 2 m/sec or more in the circumferential speed of rotor blades. When the stirring condition is less than 2 m/sec, the granulation tends to be insufficient. In the exemplary embodiment, the mother liquid of toner is granulated in an aqueous medium containing an inorganic dispersant and thereafter the solvent is removed. The solvent may be removed under the conditions of room temperature (25° C.) and normal pressure. However, since it takes a long time to remove, it is preferable that the removal of the solvent be carried out under a temperature condition in which a temperature is lower than a boiling point of the solvent and the difference between the temperature and the boiling point is less than or equal to 80° C. The pressure may be normal pressure or reduced pressure, but in a case of reduced pressure, the removal of the solvent is carried out under a reduced pressure of preferably from 20 mmHg to 150 mmHg.

The toner according to the exemplary embodiment may preferably be washed with hydrochloric acid or the like after removing the solvent. According to this, an inorganic dispersant remaining on the surface of toner particles is removed and then the composition of toner particles returns to the original composition thereof, thereby improving characteristics of toner particles. Furthermore, when dehydration and drying are performed, it is possible to obtain toner particle powder.

Inorganic oxides or the like which are represented by silica, titania, and alumina may be added and attached to the toner particles obtained by a dissolution suspension method, as an external additive in order to adjust charging, impart fluidity, impart a charge exchange property, and the like, in a similar way to the emulsification aggregation method. In addition to the above-described inorganic oxides or the like, other components (particles) such as a charge-controlling agent, organic particles, a lubricant, and an abrasive may also be added, as an external additive.

Developer

The toner according to the exemplary embodiment may be used as a single-component developer as it is or a two-component developer in which a carrier is mixed with the toner.

The carrier which may be used for the two-component developer is not particularly limited, and a well-known carrier may be used. For example, magnetic metals such as iron oxide, nickel, or cobalt and magnetic oxides such as ferrite or magnetite, a resin-coated carrier which has a resin coating layer on the surface of a core material formed of magnetic metal and magnetic oxide, and a magnetic powder-dispersed carrier may be used. In addition, a resin-dispersed carrier in which a conductive material or the like is dispersed in a matrix resin may be used.

Examples of the coating resin and the matrix resin which are used for the carrier include polyethylene, polypropylene, polystyrene, polyvinyl acetate, polyvinyl alcohol, polyvinyl butyral, polyvinyl chloride, polyvinyl ether, polyvinylketone, vinyl chloride-vinyl acetate copolymer, styrene-acrylic acid copolymer, straight silicone resin having organosiloxane bonds or a modified product thereof, fluororesin, polyester, polycarbonate, phenol resin, and epoxy resin. However, the coating resin and the matrix resin are not limited to these examples.

Examples of the conductive material include metals such as gold, silver, and copper, carbon black, titanium oxide, zinc oxide, barium sulfate, aluminum borate, potassium titanate and tin oxide. However, the conductive material is not limited to these examples.

Examples of the core material of the carrier include a magnetic metal such as iron, nickel or cobalt, a magnetic oxide such as ferrite or magnetite, and glass beads. In order to apply a magnetic brush method to the carrier, a magnetic material is preferable. In general, the volume average particle diameter of the core material of the carrier is in a range of from 10 μm to 500 μm and preferably in a range of from 30 μm to 100 μm.

In order to coat the surface of the core material of the carrier with resin, there may be used, for example, a coating method using a coating layer-forming solution which is obtained by dissolving the coating resin and, as necessary, various additives in an appropriate solvent. The solvent is not particularly limited and may be selected according to coating resin to be used, coating aptitude or the like.

Specific examples of the resin coating method include a dipping method in which the core material of the carrier is dipped in the coating layer-forming solution, a spray method in which the coating layer-forming solution is sprayed on the surface of the core material of the carrier, a fluid bed method in which the coating layer-forming solution is sprayed on the core material of the carrier in a state of floating through flowing air, and a kneader coater method in which the core material of the carrier and the coating layer-forming solution are mixed in a kneader coater and the solvent is removed.

In a two-component developer, the mixing ratio (weight ratio) of the toner according to the exemplary embodiment and the carrier is preferably in a range of from 1:100 to 30:100 (toner:carrier) and more preferably in a range of from 3:100 to 20:100.

Image Forming Apparatus

An image forming apparatus according to an exemplary embodiment includes an image holding member; a charging device that charges a surface of the image holding member; a latent image forming device that forms an electrostatic latent image on the surface of the image holding member; a developing device that develops the electrostatic latent image with the brilliant toner according to the exemplary embodiment to form a toner image; and a transfer device that transfers the toner image, formed on the surface of the image holding member, onto a recording medium.

Figure 2:
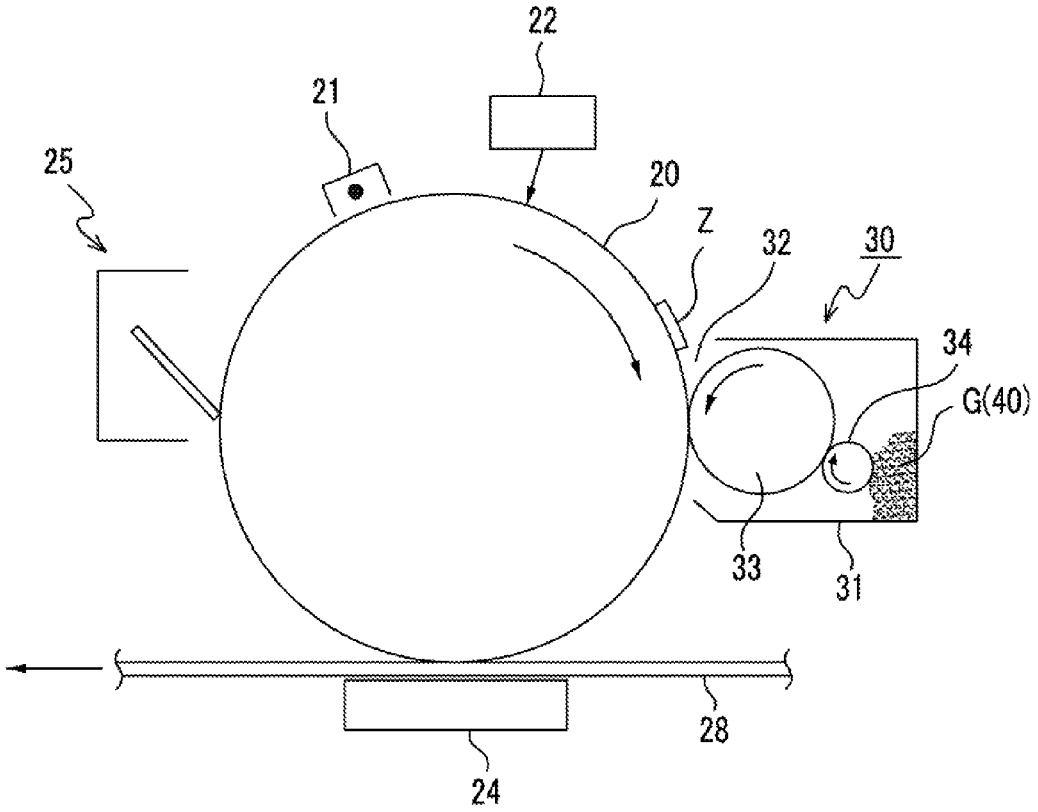
FIG. 2 is a configuration diagram schematically showing an image forming apparatus according to an exemplary embodiment.

FIG. 2 is a configuration diagram schematically showing an image forming apparatus according to an exemplary embodiment that includes a developing device to which the toner according to the exemplary embodiment is applied.

In FIG. 2, the image forming apparatus according to the exemplary embodiment includes a photoreceptor drum 20 as an image holding member that rotates in a predetermined direction. In the vicinity of the photoreceptor drum 20, a charging device 21 that charges the photoreceptor drum 20, an exposing device 22, for example, as a latent image forming device that forms an electrostatic latent image Z on the photoreceptor drum 20, a developing device 30 that develops the electrostatic latent image Z formed on the photoreceptor drum 20 into a visual image, a transfer device 24 that transfers a toner image having become a visual image on the photoreceptor drum 20 to recording paper 28 as a transfer medium, and a cleaning device 25 that cleans off the residual toner on the photoreceptor drum 20 are arranged in order.

In the exemplary embodiment, as shown in FIG. 2, the developing device 30 includes a developing housing 31 that stores a developer G containing a toner 40. In the developing housing an opening 32 for developing facing the photoreceptor drum 20 is opened, and a developing roll (developing electrode) 33 as a toner holding member facing the opening 32 for developing is disposed. When a predetermined developing bias is applied to the developing roll 33, an electric field of developing is formed in an area (developing area) which is an area interposed between the photoreceptor drum 20 and the developing roll 33. In addition, a charge injecting roll (injecting electrode) 34 as a charge injecting member that faces the developing roll 33 is disposed in the developing housing 31. Particularly, in the exemplary embodiment, the charge injecting roll 34 also functions as a toner supplying roll that supplies the toner 40 to the developing roll 33.

Herein, the rotation direction of the charge injecting roll 34 may or may not be particularly determined. However, in consideration of the properties relating to the supply of the toner and the characteristics relating to the injection of charge, a constitution is preferable in which the charge injecting roll 34 rotates in the same direction and with a circumferential speed difference (for example, equal to or more than 1.5 times) in a portion facing the developing roll 33 such that the toner 40 is inserted into the area interposed between the Charge injecting roll 34 and the developing roll 33, and injects charge while sliding.

Next, the operation of the image forming apparatus according to the exemplary embodiment will be described.

When an image forming process begins, first, the surface of the photoreceptor drum 20 is charged by the charging device 21, the exposing device 22 writes the electrostatic latent image Z on the charged photoreceptor drum 20, and the developing device 30 visualizes the electrostatic latent image Z as a toner image. Subsequently, the toner image on the photoreceptor drum 20 is transported to a transfer portion, and the transfer device 24 electrostatically transfers the toner image on the photoreceptor drum 20 to the recording paper 28 as a transfer medium. The residual toner on the photoreceptor drum 20 is cleaned by the cleaning device 25. Thereafter, the toner image on the recording paper 28 is fixed by a fixing device not shown in the drawing, whereby an image is obtained.

Process Cartridge and Toner Cartridge

Figure 3:
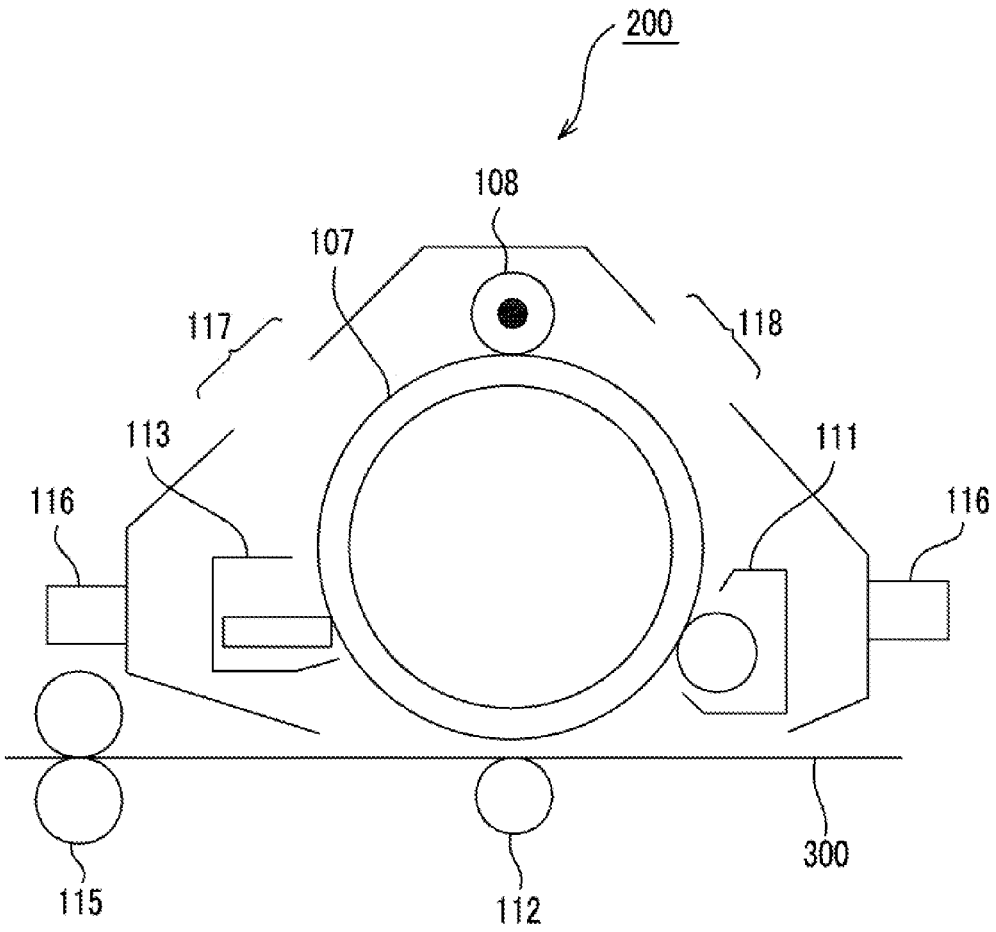
FIG. 3 is a configuration diagram schematically showing an example of a process cartridge according to an exemplary embodiment.

FIG. 3 is a configuration diagram schematically showing an example of a process cartridge according to an exemplary embodiment. The process cartridge according to the exemplary embodiment accommodates the above-described toner according to the exemplary embodiment and includes a toner holding member that holds and transports the toner.

A process cartridge 200 shown in FIG. 3 is formed by combining and integrating a photoreceptor 107 as an image holding member with a charging device 108, a developing device 111 that accommodates toe above-described toner according to the exemplary embodiment, a photoreceptor-cleaning device 113, an opening portion 118 for exposing, and an opening portion 117 for erasing charge and exposing, by using an installation rail 116. The process cartridge 200 is freely attachable to and detachable from the body of an image forming apparatus constituted with a transfer device 112, a fixing device 115, and other constitutional portions not shown in the drawing. The process cartridge 200 constitutes the image forming apparatus together with the body of the image forming apparatus. In addition, in FIG. 3, reference numeral 300 indicates a transfer medium.

The process cartridge 200 shown in FIG. 3 includes the photoreceptor 107, the charging device 108, the developing device 111, the cleaning device 113, the opening portion 118 for exposing, and the opening portion 117 for erasing charge and exposing. However, these devices may be selectively combined. The process cartridge according to the exemplary embodiment includes the developing device 111 and at least one kind selected from a group consisting of the photoreceptor 107, the charging device 108, the cleaning device (cleaning unit) 113, the opening portion 118 for exposing, and the opening portion 117 for erasing charge and exposing.

Next a toner cartridge according to an exemplary embodiment of the invention will be described. The toner cartridge according to the exemplary embodiment is freely attachable to and detachable from the image forming apparatus and accommodates a toner which is supplied to a developing unit provided in the image forming apparatus, in which the toner is the above-described toner according to the exemplary embodiment. The toner cartridge according to the exemplary embodiment just needs to accommodate at least the toner, and depending on the mechanism of the image forming apparatus, the toner cartridge may accommodate the developer, for example.

The image forming apparatus shown in FIG. 2 has a configuration in which a toner cartridge (not shown in the drawing) is freely attached to or detached from the apparatus. The developing device 30 is connected to the toner cartridge through a toner supply tube not shown in the drawing. In addition, when there is little toner accommodated in the toner cartridge, the toner cartridge may be replaced.

EXAMPLES

The present exemplary embodiment will be described below in more detail based on examples and comparative examples, but the present invention is not limited to the following examples. In addition, "part(s)" and "%" are based on weight unless otherwise specified.

Example 1

Synthesis of Binder Resin

Dimethyl adipate: 74 parts
Dimethyl terephthalate: 192 parts
Bisphenol A ethylene oxide adduct: 216 parts
Ethylene glycol: 38 parts
Tetrabutoxytitanate (catalyst): 0.037 part The above components are put in a two-neck flask dried by heating, nitrogen gas is put into the container to maintain an inert gas atmosphere, and the temperature is raised under stirring. Thereafter, a copolycondensation reaction is caused at 160° C. for 7 hours, and then the temperature is raised to 220° C. while the pressure is slowly reduced to 10 Torr, and the temperature is held for 4 hours. The pressure is temporarily returned to normal pressure, and then 9 parts of trimellitic anhydride is added. The pressure is then slowly reduced again to 10 Torr, and the temperature is held at 220° C. for an hour, thereby synthesizing binder resin.

The glass transition temperature (Tg) of the binder resin is measured with a differential scanning calorimeter (manufactured by Shimadzu Corporation, DSC-50) according to ASTMD 3418-8 under the conditions of a temperature range from room temperature (25° C.) to 150° C. and a rate of temperature rise of 10° C./min. The glass transition temperature is defined as a temperature at the intersection between lines extending from a base line and a rising line in an endothermic portion. The glass transition temperature of the binder resin is 63.5° C.

Preparation of Resin Particle Dispersion
Binder resin: 160 parts
Ethyl acetate: 233 parts
Aqueous sodium hydroxide solution (0.3 N): 0.1 part The above components are put in a 1000 ml separable flask, followed by heating at 70° C., and the resultant is stirred with a THREE-ONE MOTOR (manufactured by Shinto Scientific Co., Ltd.), thereby preparing a resin mixture solution. While this resin mixture solution is further stirred at 90 rpm, 373 parts of ion exchange water is gradually added thereto to cause phase inversion emulsification, and the solvent is removed, thereby obtaining a resin particle dispersion (solid content concentration: 30%).

Preparation of Release Agent Dispersion
Carnauba wax (manufactured by TOA KASEI CO., LTD., RC-160): 50 parts
Anionic surfactant (manufactured by DAI-ICHI KOGYO SEIYAKU CO., LTD., NEOGEN RK): 1.0 part
Ion exchange water: 200 parts The above components are mixed and heated to 95° C., and dispersed using a homogenizer (manufactured by IKA, ULTRA TURRAX T50). Thereafter, the resultant is dispersed for 360 minutes by using a MANTON-GAULIN high pressure homogenizer (manufactured by Gaulin Corporation), thereby preparing a release agent dispersion (solid content concentration: 20%) in which release agent particles are dispersed.

Preparation of Brilliant Metallic Pigment of which Surface is Covered with Metal Oxides (Aluminum Pigment Covered with Silica)

154 parts (100 parts as aluminum content) of an aluminum pigment (manufactured by SHOWA ALUMINUM POWDER K.K., 2173EA, solid content 65%) is added to 500 parts of methanol, followed by stirring at 50° C. for 1.5 hours. Thereafter, ammonia is added to the slurry, and then the pH value of the slurry is adjusted to 8.0. Next, 50 parts of tetraethoxysilane is added to the pH adjusted slurry, followed by further stirring at 60° C. for 5 hour. Thereafter, the slurry is filtered and the obtained slurry containing an aluminum pigment to be covered is dried at 110° C. for 3 hours, thereby obtaining an aluminum pigment covered with silica.

Preparation of Brilliant Metallic Pigment Dispersion
Aluminum pigment covered with silica: 100 parts
Anionic surfactant (manufactured by DAI-ICHI KOGYO SEIYAKU CO., LTD., NEOGEN R): 1.5 parts
Ion exchange water: 900 parts The above components are mixed and dispersed using an emulsification dispersing machine CAVITRON (manufactured by Pacific Machinery & Engineering Co., Ltd., CR 1010) for 1 hour. As a result, a brilliant pigment dispersion (solid content concentration: 10%), in which brilliant pigment particles (aluminum pigment particles) are dispersed, is prepared.

Preparation of Toner
Brilliant metallic pigment dispersion: 400 parts
Resin particle dispersion: 375 parts
Release agent dispersion: 50 parts The above components are put into a 2 L cylindrical stainless steel container, followed by dispersion and mixing for 10 minutes with a homogenizer (manufactured by IKA, ULTRA-TURRAX T50) while applying a shearing force at 4000 rpm. Next, 1.75 parts of 10% nitric acid aqueous solution of polyaluminum chloride as a coagulant is gradually added dropwise, followed by dispersion and mixing with the homogenizer at 5000 rpm for 15 minutes. As a result, a ram material dispersion is obtained.

Thereafter, the raw material dispersion is put into a polymerization kettle which includes a stirring device using a two-paddle stirring blade for generating a laminar flow and a thermometer, followed by heating with a mantle heater under stirring at 1000 rpm to promote the growth of aggregated particles at 54° C. At this time, the pH value of the raw material dispersion is adjusted to a range of 2.2 to 3.5 using 0.3 N nitric acid and 1 N sodium hydroxide aqueous solution. The resultant is held in the above-described pH value range for about 2 hours and aggregated particles are formed. At this time, the volume average particle diameter of the aggregated particles which is measured using a MULTISIZER II (aperture diameter: 50 μm, manufactured by Beckman Coulter, Inc.) is 10.4 μm.

Next, 125 parts of the resin particle dispersion is further added thereto so that the resin particles of the binder resin are allowed to adhere to the surfaces of the aggregated particles. The temperature is further raised to 56° C., and the aggregated particles are adjusted while observing the size and the forms of the particles with an optical microscope and a MULTISIZER II. Subsequently, in order to cause the aggregated particles to coalesce, the pH value is increased to 8.0 and then the temperature is raised to 67.5° C. After the coalescence of the aggregated particles is confirmed with the optical microscope, the pH value is decreased to 6.0 while maintaining the temperature of 67° C. After 1 hour, heating is stopped and the particles are cooled at a temperature decreasing rate of 1.0° C./min. The particles are then sieved through a 40 μm mesh, repeatedly washed with water, and then dried in a vacuum dryer. As a result, toner particles are obtained. The obtained toner particles have a volume average particle diameter of 12.2 μm.

1.5 parts of hydrophobic silica (manufactured by Nippon Aerosil Co., Ltd., RY50) and 1.0 part of hydrophobic titanium oxide (manufactured by Nippon Aerosil Co, Ltd., T805) are mixed and bleed with 100 parts of the toner particles using a sample mill at 10000 rpm for 30 seconds. Thereafter, the resultant is sieved with a vibration sieve having an aperture of 45 μm and a toner is prepared.

The volume average particle diameter of the toner is 12.2 μm. The dielectric loss factor of the toner is $29\times10^{-3}$. In addition, when a cross section of the toner in a thickness direction thereof is observed, the average value of the shortest distance from the top of the brilliant metallic pigment (aluminum, pigment covered with silica) in a long axis direction thereof to the surface of the toner (the average value of the shortest distance) is 0.42 μm.

Furthermore, "the ratio (A/B)", "the ratio (C/D) of the average maximum thickness C to the average equivalent-circle diameter D of a toner", and "when a cross section of a toner particle in a thickness direction thereof is observed, among all pigment particles to be observed, the number of pigment particles arranged so that an angle formed by a long axis direction of the toner particle in the cross section and a long axis direction of a pigment particle is in the range of −30° to +30°" (hereinafter, simply referred to as "the number of pigment particles in the range of ±30°") are measured in the above-described methods. The results thereof are shown in Table 1 below.

Preparation of Carrier

Ferrite particles (volume average particle diameter: 35 μm): 100 parts

Toluene: 14 parts

Perfluoroacrylate copolymer (critical surface tension: 24 dyn/cm): 1.6 parts

Carbon black (trade name: VXC-72, manufactured by Cabot Corporation, volume resistivity: 100 Ωcm or less): 0.12 part Cross-linked melamine resin particles (average particle diameter: 0.3 μm, insoluble in toluene): 0.3 part First, the carbon black is diluted with the toluene and added to the perfluoroacrylate copolymer, followed by dispersion with a sand mill. Then, in the resultant, the above components other than the ferrite particles are dispersed with a stirrer for 10 minutes. As a result, a coating-layer-forming solution is prepared. Then, the coating-layer-forming solution and the ferrite particles are put into a vacuum degassing kneader, followed by stirring at 60° C. for 30 minutes. The pressure is reduced and the toluene is removed by distillation to form a resin coating layer. As a result, a carrier is obtained.

Preparation of Developer 36 parts of the toner and 414 parts of the carrier are put into a 2 liter V blender, followed by stirring for 20 minutes. Then, the resultant is sieved through a 212 μm mesh to prepare a developer.

Evaluation Test

An image for evaluation is formed with the following method.

A developer unit of a DOCUCENTRE COLOR 400 (manufactured by Fuji Xerox Co., Ltd.) is filled with a sample developer and is left to stand for 24 hours in an environment of a temperature of 40° C. and a humidity of 70%. Thereafter, 10000 sheets of 1 cm×10 cm solid images (amount of toner particles deposited: 4.5 g/m$^2$) formed on a recording paper (OK TOPCOAT+ paper, manufactured by Oji Paper Co., Ltd.) are continuously printed under conditions of a fixing temperature of 190° C., a fixing pressure of 4.0 kg/cm$^2$, and a process speed of 308 mm/s. The brilliance of the obtained 10000th printed image is visually checked based on the following criteria. The evaluation results are shown in Table 1.

G4: There are no problems with brilliance.

G3: Brilliance is deteriorated to a small degree or a small amount of darkening is observed.

G2: Brilliance is deteriorated or darkening is observed but is in an allowable range.

G1: Brilliance is deteriorated or darkening is observed and is not in an allowable range.

Example 2

A toner is prepared by the same method described in Example 1, except that the brilliant metallic pigment dispersion is changed to 200 parts, the resin particle dispersion is changed to 425 parts, and the resin particle dispersion to be additionally added is changed to 141.7 parts.

The obtained toner and developer are evaluated in the same method as that of Example 1. The evaluation results are shown in Table 1.

Example 3

A toner is prepared by the same method described in Example 1, except that the brilliant metallic pigment dispersion is changed to 800 parts, the resin particle dispersion is changed to 275 parts, and the resin particle dispersion to be additionally added is changed to 91.7 parts.

The obtained toner and developer are evaluated in the same method as that of Example 1. The evaluation results are shown in Table 1.

Example 4

A toner is prepared by the same method described in Example 1, except that the frequency of stirring revolutions at the time of the growth of the aggregated particles is changed to 700 rpm.

The obtained toner and developer are evaluated in the same method as that of Example 1. The evaluation results are shown in Table 1.

Example 5

A toner is prepared by the same method described in Example 1, except that the frequency of stirring revolutions at the time of the growth of the aggregated particles is changed to 1300 rpm.

The obtained toner and developer are evaluated in the same method as that of Example 1. The evaluation results are shown in Table 1.

Example 6

A toner is prepared by the same method described in Example 1, except that the frequency of stirring revolutions at the time of the growth of the aggregated particles is changed to 500 rpm.

The obtained toner and developer are evaluated in the same method as that of Example 1. The evaluation results are shown in Table 1.

Example 7

A toner is prepared by the same method described in Example 1, except that the frequency of stirring revolutions at the time of the growth of the aggregated particles is changed to 1700 rpm.

The obtained toner and developer are evaluated in the same method as that of Example 1. The evaluation results are shown in Table 1.

Example 8

Binder resin: 150 parts

Aluminum pigment covered with silica: 40 parts

Carnauba wax (manufactured by TOA KASEI CO., LTD., RC-160): 10 parts

Ethyl acetate: 200 parts

The above components are dispersed with a ball mill for 48 hours (referred to as A liquid). Meanwhile, 120 parts of calcium carbonate (average particle diameter 80 nm) and 80 parts of water are dispersed with a ball mill for 48 hours. Thereafter, 14 parts of calcium carbonate dispersion and 200 parts of 2% aqueous solution of carboxymethyl cellulose (trade name SEROGEN BS-H: manufactured by DAI-ICHI KOGYO SEIYAKU CO., LTD.) are stirred (referred to as B liquid). Subsequently, 100 parts of B liquid is stirred with an emulsifier (trade name AUTO-HOMOMIXER: manufactured by Tokushukika Kogyo K.K.) and 400 parts of A liquid is gradually added thereto, thereby suspending the mixture. Thereafter, the solvent is removed under reduced pressure and under stirring at 1000 rpm and then 200 parts of 6 N hydrochloric acid is added thereto to remove calcium carbonate, followed by further washing, drying and classifying. As a result, toner particles are obtained. The obtained toner particles have a volume average particle diameter of 12.5 μm.

A toner and a developer are obtained as in Example 1, except that the above toner particles are used. The obtained toner and developer are evaluated in the same method as that of Example 1. The evaluation results are shown in Table 1.

Comparative Example 1

A toner is prepared by the same method described in Example 1, except that the brilliant metallic pigment dispersion is changed to 100 parts, the resin particle dispersion is changed to 450 parts, and the resin particle dispersion to be additionally added is changed to 150 parts.

The obtained toner and developer are evaluated in the same method as that of Example 1. The evaluation results are shown in Table 1.

Comparative Example 2

A toner is prepared by the same method described in Example 1, except that the brilliant metallic pigment dispersion is changed to 1600 parts, the resin particle dispersion is changed to 75 parts, and the resin particle dispersion to be additionally added is changed to 25 parts.

The obtained toner and developer are evaluated in the same method as that of Example 1. The evaluation results are shown in Table 1.

Comparative Example 3

A toner is prepared by the same method described in Example 1, except that, instead of an aluminum pigment covered with silica in the preparation of the brilliant metallic pigment dispersion, an aluminum pigment covered with resin (manufactured by SHOWA ALUMINUM POWDER K.K., 2173EA) is used.

The obtained toner and developer are evaluated in the same. Method as that of Example 1. The evaluation results are shown in Table 1.

Comparative Example 4

In Comparative Example 4, a toner is prepared by a kneading and grinding method.

Binder resin: 600 parts

Aluminum pigment covered with silica: 240 parts

Carnauba wax (manufactured by TOA KASEI CO., LTD., RC-160): 60 parts

The above components are weighed, and then uniformly mixed with a powder mixer such as a ball mill. The obtained mixture is heated and melted with a screw extruder, a roll mill, a kneader or the like and further kneaded. After the kneading is completed, the obtained kneaded mixture is cooled and solidified. The solidified kneaded mixture is first coarsely crushed with a coarse crusher such as a hammer mill, a cutter mill, and then finely pulverized with a fine pulverizer such as a jet mill. After the fine pulverization is completed, the obtained finely pulverized particles are classified with an ELBOW JET CLASSIFIER or the like in order to remove fine particles and coarse particles. The obtained toner particles have a volume average particle diameter of 13.2 μm.

The obtained toner and developer are evaluated in the same method as that of Example 1. The evaluation results are shown in Table 1.

TABLE 1

| | Dielectric loss factor ($\times 10^{-3}$) | Average value of shortest distance (μm) | Ratio (A/B) | Number of Pigment Particles in Range of ±30° (%) | Ratio (C/D) | Brilliance |
|---|---|---|---|---|---|---|
| Example 1 | 29 | 0.42 | 58 | 84 | 0.081 | 4 |
| Example 2 | 12 | 0.43 | 42 | 83 | 0.079 | 3 |
| Example 3 | 56 | 0.41 | 62 | 81 | 0.075 | 4 |
| Example 4 | 31 | 0.13 | 55 | 82 | 0.125 | 3 |
| Example 5 | 28 | 0.89 | 61 | 86 | 0.74 | 4 |
| Example 6 | 30 | 0.09 | 25 | 75 | 0.42 | 2 |
| Example 7 | 29 | 1.05 | 75 | 86 | 0.067 | 4 |
| Example 8 | 30 | 0.35 | 30 | 78 | 0.13 | 3 |
| Comparative Example 1 | 9.5 | 0.55 | 1.2 | 82 | 0.082 | 1 |
| Comparative Example 2 | 63 | 0.35 | 0.8 | 86 | 0.089 | 1 |

TABLE 1-continued

| | Dielectric loss factor ($\times 10^{-3}$) | Average value of shortest distance (μm) | Ratio (A/B) | Number of Pigment Particles in Range of ±30° (%) | Ratio (C/D) | Brilliance |
|---|---|---|---|---|---|---|
| Comparative Example 3 | 62 | 0.43 | 1.9 | 85 | 0.082 | 1 |
| Comparative Example 4 | 150 | 0.01 | 0.2 | 54 | 0.53 | 1 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising:

a brilliant metallic pigment selected from the group consisting of aluminum, brass, bronze, nickel, stainless steel, and zinc, the brilliant metal pigment having a surface covered with at least one metal oxide selected from the group consisting of silica, alumina, and titania, wherein the toner has a dielectric loss of from $10\times10^{-3}$ to $60\times10^{-3}$, and wherein an average value of a shortest distance from a top of the brilliant metallic pigment in a long axis direction thereof to a surface of the toner is from 0.1 μm to 1.0 μm.

2. The brilliant toner according to claim 1, wherein, when a solid image is formed, a ratio (A/B) of a reflectance A at a light receiving angle of +30° to a reflectance B at a light receiving angle of −30°, which are reflectances measured when the image is irradiated with incident light at an incident angle of −45° using a goniophotometer, is from 2 to 100.

3. The brilliant toner according to claim 1, wherein the toner has an average equivalent circle diameter D larger than an average maximum thickness C of the toner.

4. The brilliant toner according to claim 1, wherein a ratio (C/D) of an average maximum thickness C of the toner to an average equivalent circle diameter D of the toner is in a range of from 0.001 to 0.500.

5. The brilliant toner according to claim 1, wherein a number of pigment particles arranged so that an angle formed by a long axis direction of the toner in the cross section and a long axis direction of a pigment particle is in a range of −30° to +30° is equal to or greater than 60% of the number of pigment particles.

6. The brilliant toner according to claim 1, wherein the brilliant metallic pigment has a volume average particle diameter of less than or equal to 20 μm.

7. The brilliant toner according to claim 1, wherein the toner contains a binder resin and the content of the brilliant metallic pigment is from 1 part by weight to 70 parts by weight with respect to 100 parts by weight of the binder resin.

8. The brilliant toner according to claim 1, wherein the binder resin is a polyester resin.

9. The brilliant toner according to claim 8, wherein the polyester resin contains an aromatic carboxylic acid as a structural component.

10. The brilliant toner according to claim 8, wherein the polyester resin contains a trivalent or higher carboxylic acid as a structural component.

11. The brilliant toner according to claim 1, further comprising a release agent.

12. The brilliant toner according to claim 11, wherein the release agent has a melting temperature of from 50° C. to 100° C.

13. The brilliant toner according to claim 11, wherein a content of the release agent is from 0.5% by weight to 15% by weight.

14. The brilliant toner according to claim 1, wherein the toner has a volume average particle diameter of from 1 μm to 30 μm.

15. A developer comprising at least the brilliant toner according to claim 1.

16. The developer according to claim 15, further comprising a carrier having a core material, wherein a volume average particle diameter of the core material is from 10 μm to 500 μm.

17. A toner cartridge which contains the brilliant toner according to claim 1.

18. A process cartridge which contains the brilliant toner according to claim 1 and includes a toner holding member that holds and transports the brilliant toner.

19. An image forming apparatus comprising:

an image holding member;

a charging device that charges a surface of the image holding member;

a latent image forming device that forms an electrostatic latent image on the surface of the image holding member;

a developing device that contains the brilliant toner according to claim 1 and develops the electrostatic latent image with the brilliant toner to form a toner image; and a transfer device that transfers the toner image, formed on the surface of the image holding member, onto a recording medium.

20. The brilliant toner according to claim 2, wherein the ratio (A/B) is from 60 to 90.

* * * * *